US006976872B1

(12) United States Patent
Wild et al.

(10) Patent No.: US 6,976,872 B1
(45) Date of Patent: Dec. 20, 2005

(54) COAXIAL CONNECTOR

(75) Inventors: Werner Wild, Buttenwiesen-Unterthürheim (DE); Thomas Binder, Bruckmühl (DE)

(73) Assignee: Spinner GmbH, Munich (DE)

( * ) Notice: Subject to any disclaimer, the term of this patent is extended or adjusted under 35 U.S.C. 154(b) by 126 days.

(21) Appl. No.: 10/465,530

(22) Filed: Jun. 20, 2003

(30) Foreign Application Priority Data

Jun. 22, 2002 (DE) ..... 102 27 985

(51) Int. Cl.[7] ..... H01R 9/05
(52) U.S. Cl. ..... 439/578; 439/587; 439/274
(58) Field of Search ..... 439/578–585, 439/684, 675, 932, 587, 274, 275

(56) References Cited

U.S. PATENT DOCUMENTS 5,951,327 A 9/1999 Marik
6,148,513 A 11/2000 Schiefer et al.
6,439,924 B1 * 8/2002 Kooiman ..... 439/578
6,441,706 B1 * 8/2002 Nelson ..... 333/260
6,767,247 B2 * 7/2004 Rodrigues et al. ..... 439/578
6,783,394 B1 * 8/2004 Holliday ..... 439/578
6,817,897 B2 * 11/2004 Chee ..... 439/578
6,830,479 B2 * 12/2004 Holliday ..... 439/585
6,848,941 B2 * 2/2005 Wlos et al. ..... 439/585

FOREIGN PATENT DOCUMENTS

EP 0 629 025 A2 12/1994

* cited by examiner

*Primary Examiner*—Hien Vu
(74) *Attorney, Agent, or Firm*—Edell, Shapiro & Finnan

(57) ABSTRACT

In a coaxial connector, especially an integrally pre-mounted connector, the recess (7*a*) receiving the end of the coaxial cable can be sealed in the connector head (7) relative to the cable with the help of an integrated perimeter seal (10). For this purpose the perimeter seal (10) is received in a form-fitting manner in a pressure member (9) which establishes the electric connection between the outer cable conductor (3) and the conductor head (7) and connects the same in a manner so as to be secure against withdrawal. The perimeter seal comprises at least one and preferably several ring-like lips (10*a*, 10*b*, 10*c*) which project radially inwardly, deform when the pressure member (9) is slid onto the cable in the direction of its end (3*a*) and, after the clamping of the pressure member, stand again in the same radial plane as in the unloaded state.

8 Claims, 8 Drawing Sheets

COAXIAL CONNECTOR

BACKGROUND OF THE INVENTION

1. Field of the Invention

The invention relates to a coaxial connector with a connector head comprising a recess for receiving the end of a coaxial cable and a cable clamp which comprises at least one pressure member which encompasses the coaxial cable, can be clamped with the connector head and, after clamping with the connector head, establishes electric contact between at least the outer conductor of the cable and the connector head and joins them mechanically in a manner so as to be secure from withdrawal, with the recess in the connector head being sealed relative to the cable.

2. Description of the Related Art

Such connectors intended for mounting at the end of a coaxial cable are known in arrangements comprising several parts to be mounted and, according to the current state of the art, in arrangements where they are pre-mounted in an integral design (cf. DE 197 34 236 C2, DE 197 38 733 C1, DE 198 57 528 C2 and EP 1 028 498 A1).

For the purpose of sealing the connector head relative to the cable there is either one or more O-rings or an intermediate space between the cable clamp and the cable that is filled with a permanently elastic plastic material. Instead of or in addition to this, cable bushings or shrinkdown plastic tubing is used. O-rings and cable bushings or other shaped rubber parts have the disadvantage of being unable to cover the entire tolerance range of the respective outer conductors of the cable. Moreover, deformations, and especially subsequent deformations of the outer conductor of the cable in the region of the transition into the connector, will inevitably lead to leakiness. Sealing by means of shrinkdown plastic tubing comes with the disadvantage that at the frequently exposed mounting locations it is necessary to work with hot air. Even in the case of connectors which can be mounted integrally, all these sealing means must be provided as separate parts and must be mounted separately.

SUMMARY OF THE INVENTION

The invention is based on the object of providing a connector of the kind mentioned above, but with an integrated seal, so that in the case of an integral pre-mounted connector the mounting is limited to the usually prepared cable with the insertion of the connector and the tightening of the cable clamp and for the disassembly it is only necessary to loosen the cable clamp.

This object is achieved in a coaxial connector of the kind mentioned above in such a way that in the pressure member an elastic perimeter seal is arranged which comprises at least one annular lip which in the unloaded state projects in a radially inward fashion, namely to such an extent that on the one hand the clear inside diameter of the perimeter seal is smaller than the largest outer diameter of the outer conductor of the cable and on the other hand the lip deforms when the pressure member is slid onto the cable, namely especially in the direction of its end, and that after the clamping the lip of the perimeter seal is situated again in the same radial plane as in the unloaded state.

The seal can thus be an integral part of the connector and can be designed in such a way that a large tolerance range of the diameter of the outer connector of the cable and even deformations of the latter are overcome by maintaining the seal. In this respect, the seal of the recess of the connector head towards the cable by means of the elastic perimeter seal with at least one annular lip is principally independent of the other, multiple-part or integral construction of the connector and is also independent of whether or not the coaxial cable has a smooth-walled or ring-corrugated outer cable conductor. The pressure member can be a banjo bolt, a coupling ring with inside thread or a small flange which is clamped with the connector head by means of tie-bolts.

Preferably, the perimeter seal is fixed in the pressure member in a form-fitting manner (claim 2).

The perimeter seal can especially be fixed in at least one annular groove in the pressure member (claim 3).

At best, the lip of the perimeter seal rests on the outer cable conductor (claim 4).

A further improvement is that the perimeter seal is arranged in a sleeve-like manner and, at an axial distance from the lip, at least one further lip is provided which is arranged in a similar way (claim 5).

At least one of the further lips can be arranged so as to be placed on the cable sheath (claim 6).

The sleeve-like perimeter seal can be housed completely in the pressure member. Alternatively, the sleeve-like perimeter seal projects beyond the pressure member on the cable side and the further lip can be arranged on the cable-side end of the perimeter seal (claim 7).

In this case it is appropriate when a cap nut for axial and thus also radial compression of the further lip can be screwed onto the cable-side end of the pressure member (claim 8).

An embodiment which is especially suitable for coaxial cables with ring-wave outer cable conductors is characterized in that the radial plane in which the lip(s) is/are situated after the clamping intersects the outer cable conductor on the transition from one wave crest to the next wave trough away from the cable end (claim 9).

A slender construction is especially obtained when the pressure member is a banjo bolt which can be twisted into the recess of the connector head (claim 10).

In the embodiment of the sealed connector which is most advantageous concerning the mounting the latter can be slid onto the cable in one piece in a completely pre-mounted fashion and is provided with an arrangement which allows it to be put into contact and clamped with the same (claim 11), e.g. in analogy to the construction known from DE 197 38 733 C1.

BRIEF DESCRIPTION OF THE DRAWINGS

Several embodiments of the connector in accordance with the invention are shown in the drawings in a schematically simplified longitudinal sectional view, wherein.

DESCRIPTION OF THE PREFERRED EMBODIMENTS

Figure 1:
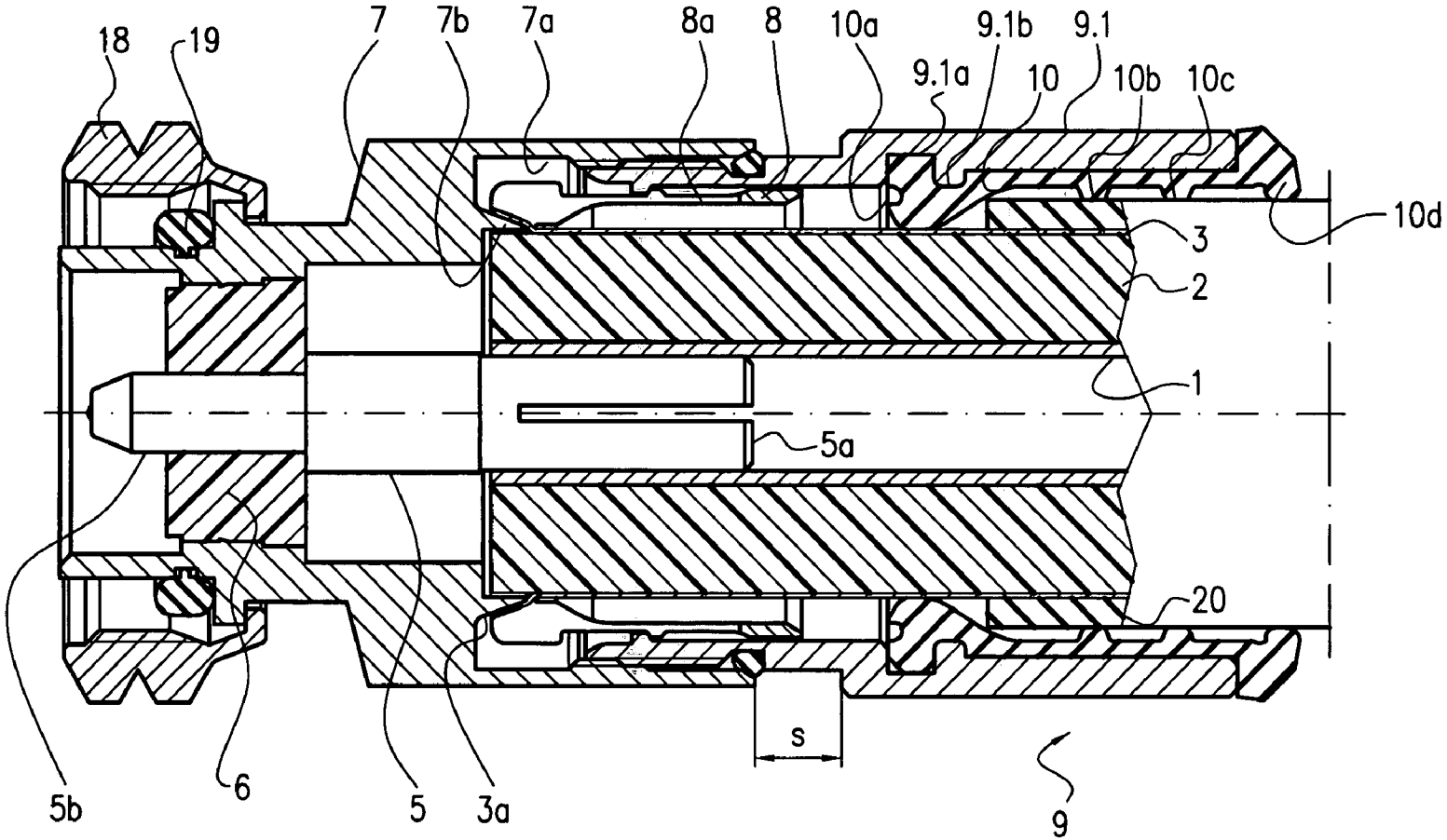
FIG. 1 shows a first embodiment of the connector for a coaxial cable with a smooth outer cable conductor, prior to the completion of mounting.
Figure 2:
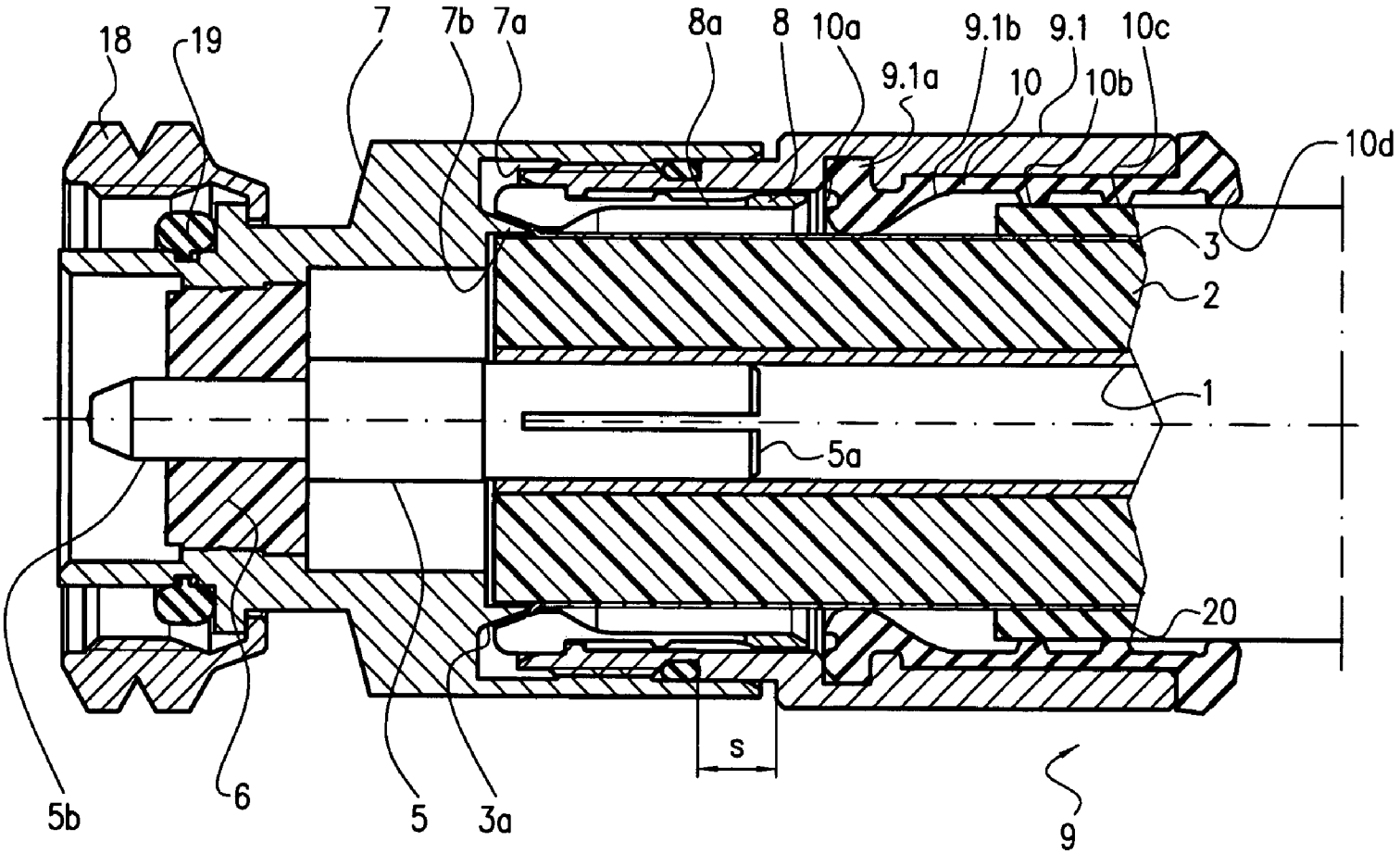
FIG. 2 shows the same embodiment after completed mounting.

The coaxial cables which are shown in the figures in an exemplary manner in the figures merely for explaining the invention comprise as usual a tubular center cable conductor 1, a cable dielectric 2, an outer cable conductor which in the case of FIGS. 1 and 2 is a smooth-wall outer conductor 3 and in the case of the other figures a ring-wave outer cable conductor 4, as well as a cable sheath 20.

All figures are based on the same connector in a so-called monobloc arrangement which is only chosen as an example. It comprises the inner conductor 5 of the connector which is arranged on the cable side as a slotted sleeve 5*a* which engages in the inner cable conductor 1. The inner connector conductor 5 is held in a connector head 7 by means of an insulating material support 6. On the plug side, the inner connector conductor 5 is arranged as a pin 5*b* merely as an example. For the purpose of connecting with a counter connector, which in this case is therefore a female connector, the connector head 7 carries a captively held cap nut 18 and an O-ring 19 for sealing.

On the cable side, the connector head 7 comprises a recess 7*a* which receives the end of the coaxial cable and whose floor comprises a conical ring surface 7*b*. A contact sleeve 8 is situated in the recess, which sleeve comprises axial slots in regular intervals over the majority of its length, so that the contact sleeve 8 consists in this region of radially resilient segments 8*a* whose free ends are provided with a thicker arrangement and are used for making the electric contact and providing the mechanical clamping of the facing edge region of the respective outer cable conductor 3 and 4 relative to the conical ring surface 7*b*.

For clamping the coaxial cable there is a pressure member in the form of a sleeve 9 whose plug-side section is arranged as a banjo bolt with an outer thread section which can be twisted into a corresponding inside thread section of the conductor head 7 in the region of its recess 7*a*. The plug-side end region of the sleeve 9 cooperates with the thickened ends of the contact sleeve 8 in a manner as explained in closer detail in DE 198 57 528 C2 on this side.

In the embodiment according to FIGS. 1 and 2 a sleeve-like perimeter seal 10 of high elasticity is fixed in a form-fitting manner in the cable-side section of sleeve 9.1. The sleeve-like perimeter seal 10 comprises a first ring-like lip 10*a* which in the unloaded state (i.e. before the connector is slid onto the end of the coaxial cable) has an inside diameter which is smaller than the largest outer diameter of the outer cable conductor 3 which is smooth-walled in this case, i.e. it is smaller than its diameter in the region of its flanged end 3*a*. The dimensions of the inside diameter of the sleeve 9.1 is chosen such that the lip 10*a* of the tubular perimeter seal 10 has a radial width which is sufficient at the lip 10*a*, when the connector is pushed onto the end of the coaxial cable, is able to evade the flanged end 3*a* of the outer cable conductor 3 by deformation, i.e. by displacement in the direction of the plug side of the connector. This displacement is promoted through a suitable profiling of the lip. In order to achieve a form-fit, the perimeter seal 10 engages in an annular groove 9.1*a* of the sleeve 9.1. in the region of its lip 10*a*, which sleeve on its part comprises an inwardly radially projecting ring shoulder 9.1*b* which engages in a corresponding annular groove in the perimeter seal 10. The perimeter seal 10 extends on the cable side over the entire remaining length of the sleeve 9.1 and in this section comprises two further, radially inwardly facing lips 10*b* and 10*c* whose clear inside diameter in the unloaded state is smaller than the diameter of the coaxial cable in the region of its cable sheath 20. The perimeter seal 10 reaches beyond the cable-side face surface of the sleeve 9.1. In order to improve the form-fit, the perimeter seal 10 grasps beyond the face surface of sleeve 9.1. For further improving the sealing, the perimeter seal 10 ends in a fourth lip 10*d* which is dimensioned like the lips 10*b* and 10*c*. After sliding the connector onto the coaxial cable against its outer cable conductor or its cable sheath, all lips of the perimeter seal 10 lie in a radially compressed and therefore well-sealing state which compensates any roundness tolerances or deformations.

For mounting purposes, the connector is pushed in the defined pre-mounted form as illustrated in FIG. 1 onto the cable end which is suitably prepared in the axial direction until the stop is reached (3*a* on 7*b*). Preferably, the sleeve 9 is twisted in while the connector head 7 is held tightly until a predetermined clamping torque is reached. In this respect the sleeve 9 travels by a constructively determined clamping path s into the recess 7*a* of the connector head 7 until the readily mounted state as illustrated in FIG. 2 is reached.

Figure 3:
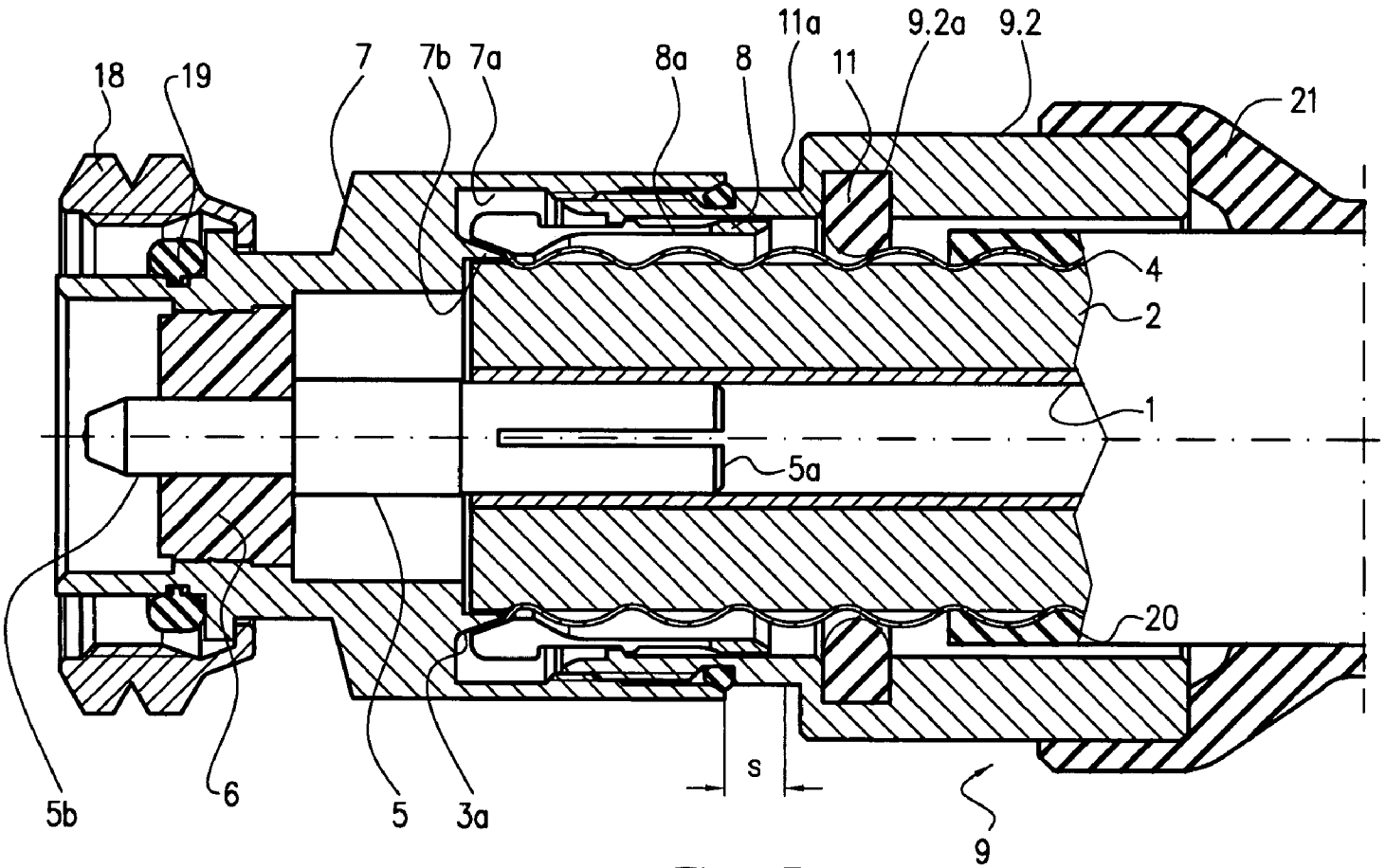
FIG. 3 shows a second embodiment of the connector for a coaxial cable with a ring-wave outer conductor, prior to the completion of the mounting.
Figure 4:
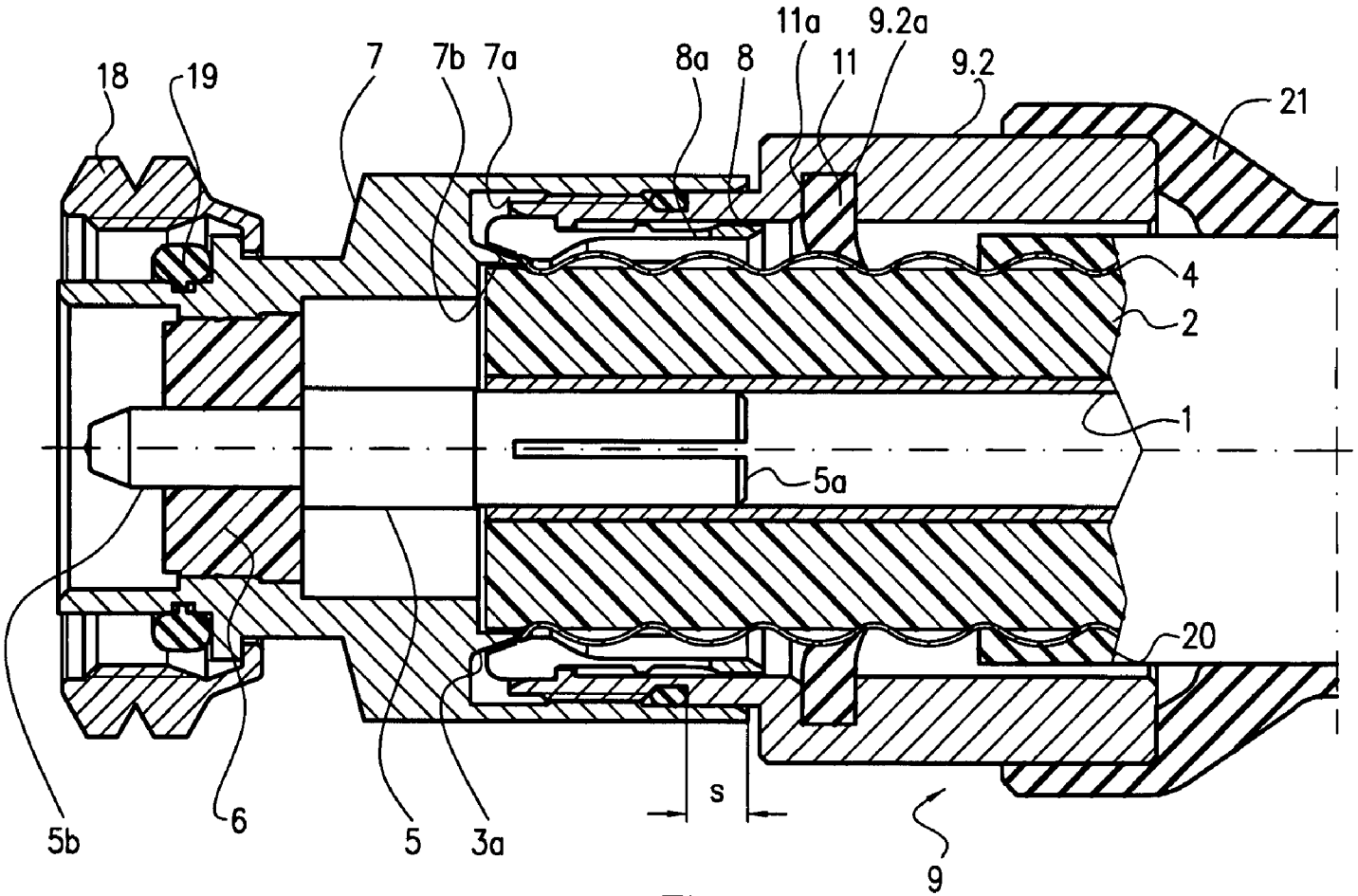
FIG. 4 shows a second embodiment after the completion of the mounting.

FIGS. 3 and 4 illustrate a second embodiment of the connector which is especially intended for mounting on a coaxial cable with a ring-wave outer cable conductor 4. With the exception of the differences explained below, the connector is similar to the connector described, above, with respect to FIGS. 1 and 2. The connector comprises a sleeve 9.2 which receives an elastic perimeter seal 11 in a form-fitting manner, with the ring-shaped lip 11*a* of the seal having an inside diameter in the unloaded state which is smaller than the smallest diameter of the outer cable conductor 4 in the region of the wave trough. At the same time, the inside diameter of the sleeve 9.2 is dimensioned in such a way that the lip 11*a* has a sufficient radial width which allows it to yield in the direction of the plug side for example when the connector is slid onto the coaxial cable. The positioning of the perimeter seal 11 within the sleeve 9.2 and thus also relating to the base of the recess 7*a* of the connector head 7 is chosen in such a way that the lip 11*a* of the perimeter seal 11, after the completion of the mounting (as described above in connection with FIGS. 1 and 2), is situated or rests on the transition from one wave crest to the next wave trough of the outer cable conductor 4 away from the cable end by taking into account the clamping path 2 according to FIG. 4. In this position one not only obtains a stronger radial compression and thus an improved sealing effect for the perimeter seal 11 in comparison with its positioning in a wave trough, but the perimeter seal 11 is also capable of compensating larger tolerances and optionally deformations of the outer cable conductor in the region of the transition from one wave crest to a wave trough of the outer cable conductor 4. To the extent that this aspect is irrelevant due to narrower tolerances of the outer cable conductor, the perimeter seal 11 can also be positioned in such a way that its lip 11*a* rests on a wave crest or the apex of the respective ring undulation of the outer cable conductor.

In this simplest embodiment, it is recommended to also seal the ring gap between the cable sheath 20 and the inside wall of the sleeve 9.2. Different means are known for this purpose, e.g. the circular spraying with a plastic material 21 as shown in the drawing.

Figure 5:
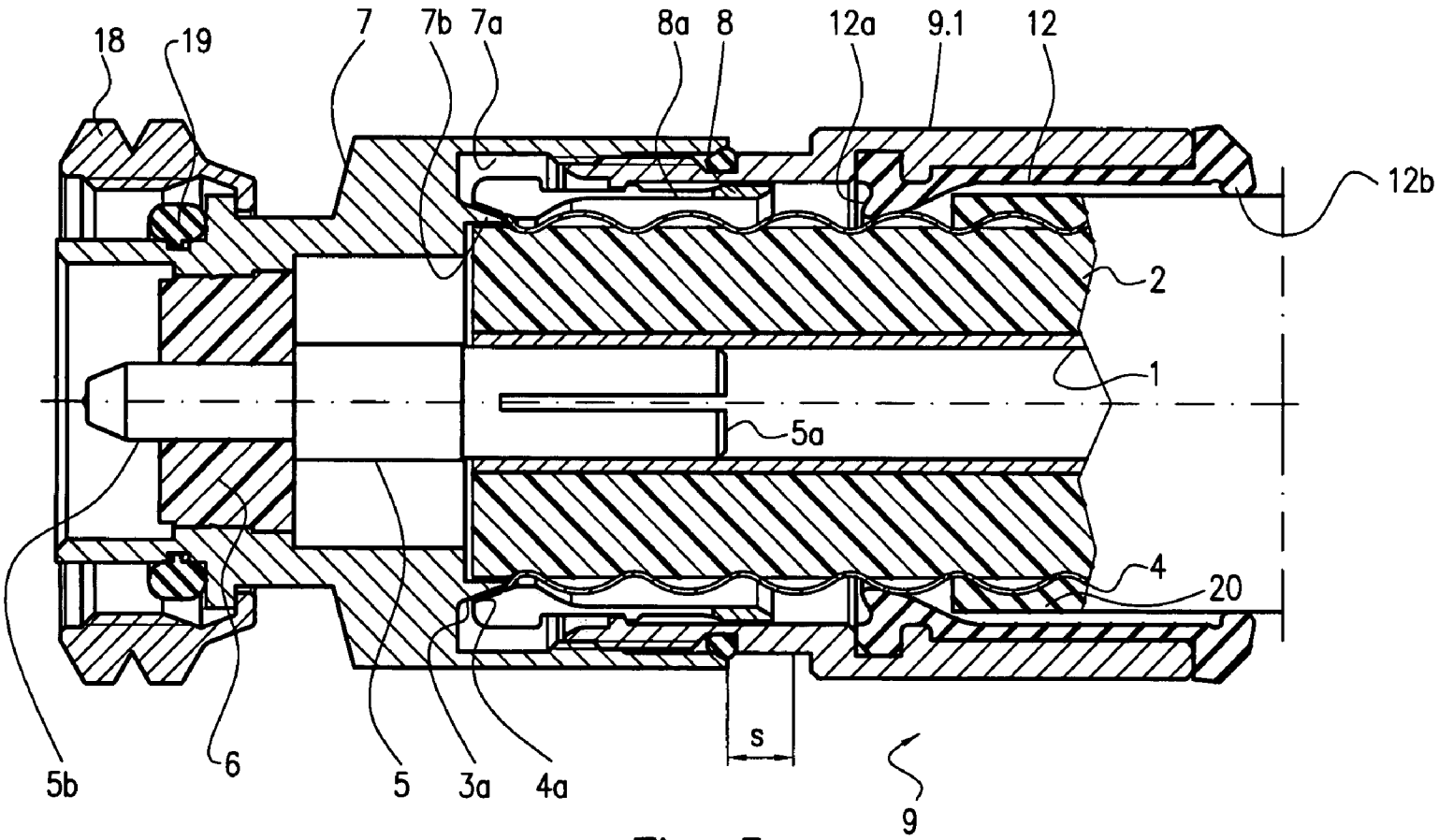
FIG. 5 shows a third embodiment of the connector prior to the completion of mounting on a coaxial cable with a ring-wave outer conductor.
Figure 6:
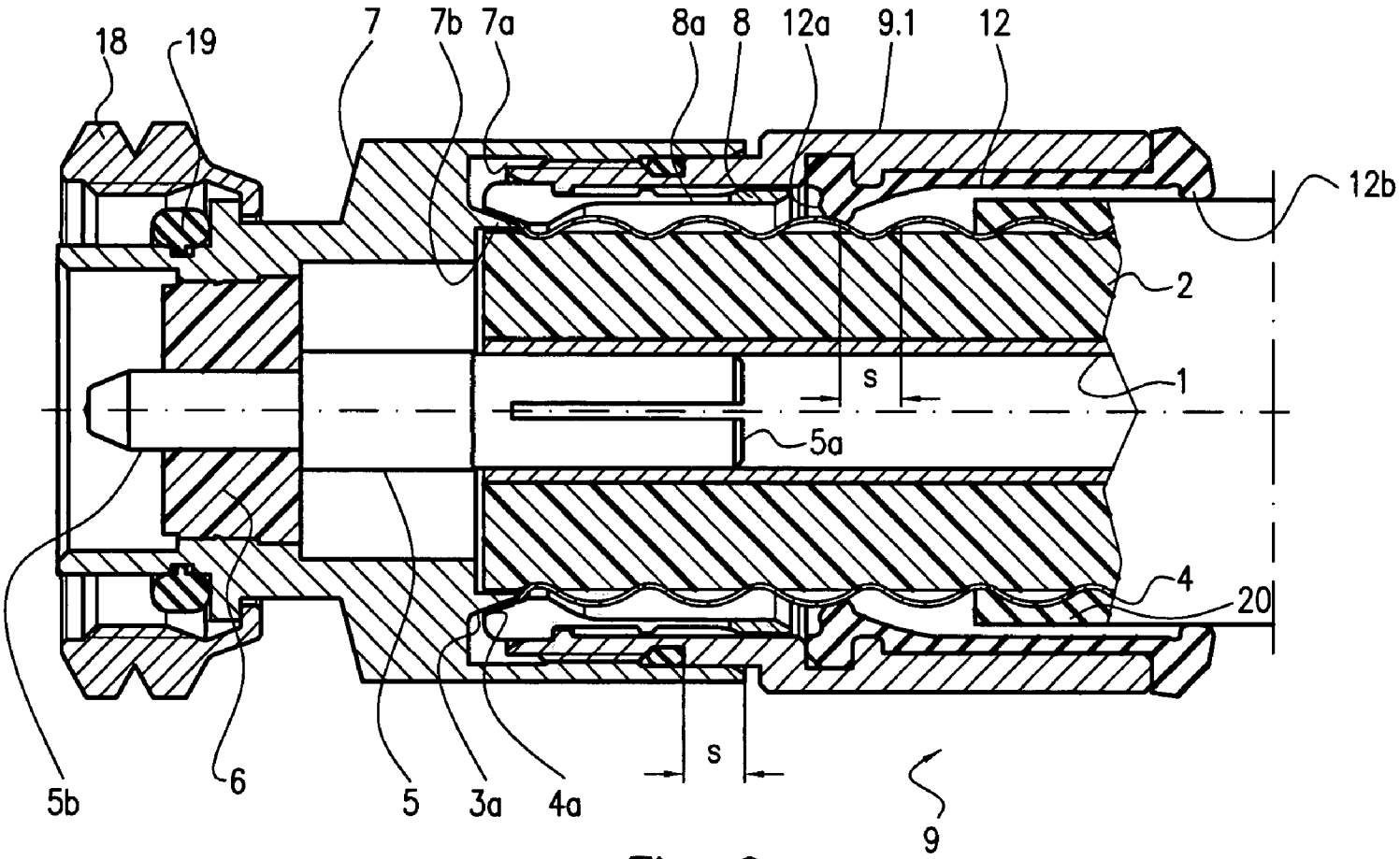
FIG. 6 shows the third embodiment after the completion of the mounting.

The third embodiment of the connector as shown in FIGS. 5 and 6 corresponds substantially to the first embodiment according to FIGS. 1 and 2 with a sleeve 9.1 which encloses a perimeter ring seal 12 which comprises a first lip 12*a* resting on the outer cable conductor and a second lip 12*b* resting on the cable sheath 20. In the pre-mounted state as shown in FIG. 5, the lip 12*a* rests on the transition from the fourth wave trough (as counted from the face edge of the outer cable conductor 4) to the fourth wave crest. In the completely mounted state as shown in FIG. 6, namely after screwing the sleeve 9.1 into the conductor head 7, the lip 12*a* has migrated forwardly by the clamping path s, i.e. approximately by half the step length of the undulation of the outer cable conductor 4, in the direction towards the plug-side end of the connector or the face edge 4*a* of the outer cable conductor. In this position the lip 12*a* of the perimeter seal can lie again in the same radial plane as in its unloaded state, i.e. in the case of a pre-mounted connector which has not yet been slid onto the cable.

Figure 7:
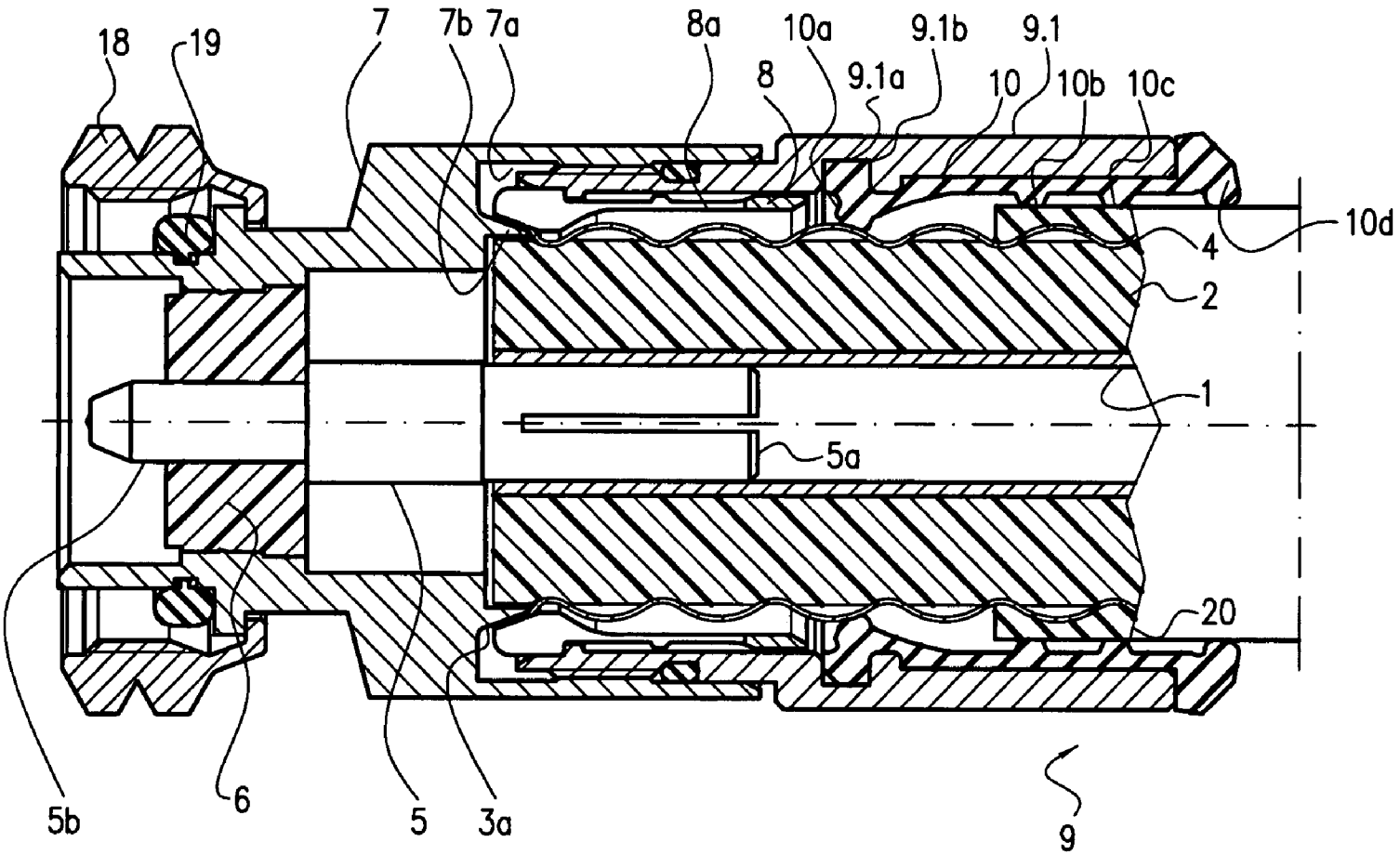
FIG. 7 shows a fourth embodiment of the connector after the completion of the mounting on a coaxial cable with a ring-wave outer conductor.

The fourth embodiment of the connector as shown in the completely mounted state in FIG. 7 differs from the third embodiment merely in such a way that the sleeve-like perimeter seal 10 is configured as in the case of FIG. 1, meaning that for improving the sealing it comprises two further lips 10*b* and 10*c* which rest on the cable sheath 20.

Figure 8:
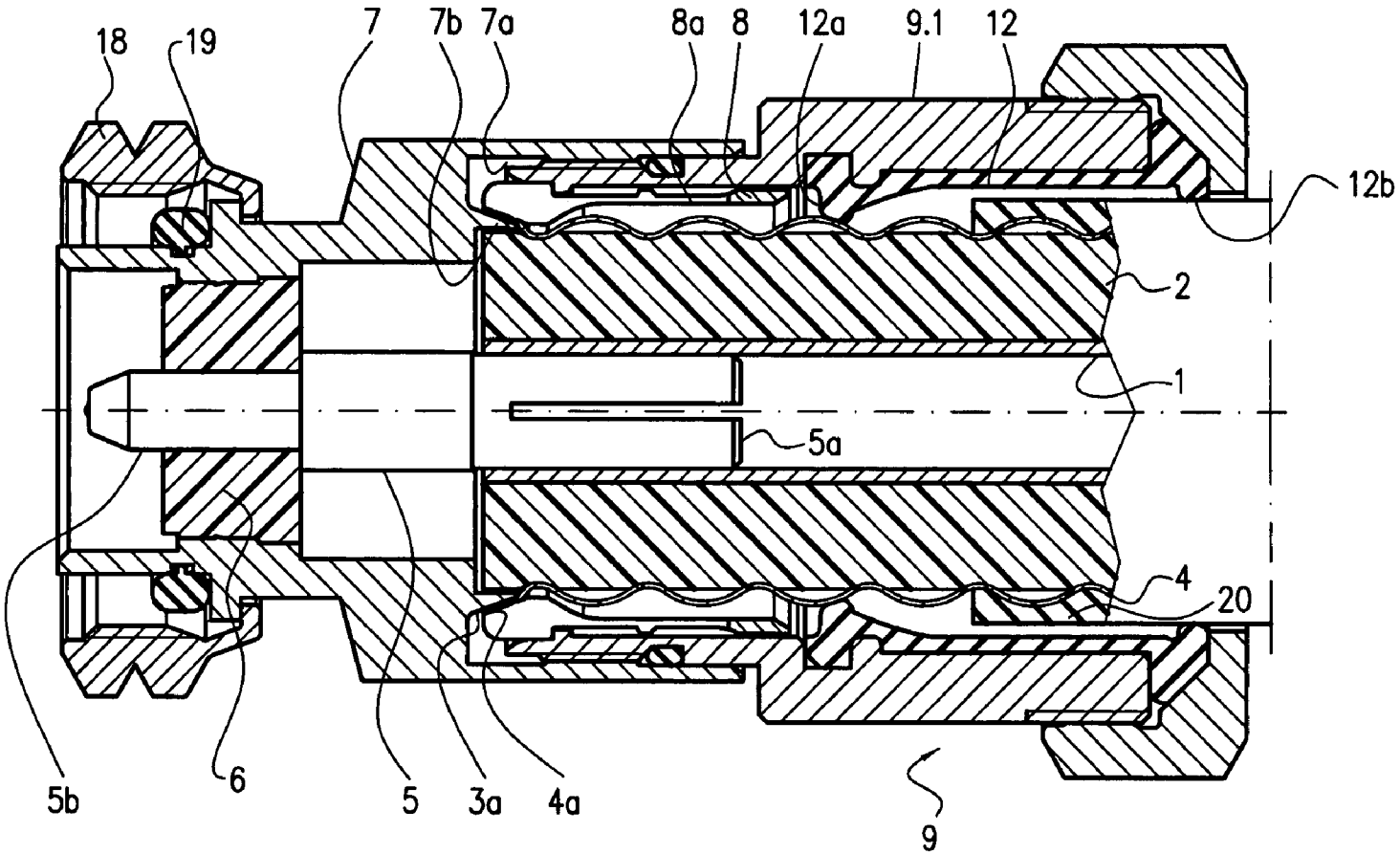
FIG. 8 shows a fifth embodiment of the connector after the completion of the mounting on a coaxial cable with a ring-wave outer conductor.

FIG. 8 finally shows an embodiment of the connector in which the sleeve-like perimeter seal 12 is arranged as in the third embodiment according to FIGS. 5 and 6, i.e. it only comprises the two lips 12*a* and 12*b*. For the purpose of axial and thus also radial compression of the outer sealing lip 12*b* a cap nut 22 is additionally screwed onto sleeve 9.1.

What is claimed is:

1. A coaxial cable connector, comprising:

a connector head comprising a recess for receiving an end of a coaxial cable; and a cable clamp comprising a pressure member which encompasses the end of the coaxial cable and is capable of being clamped by the connector head to establish electric contact between an outer conductor of the coaxial cable and the connector head and mechanically joins the coaxial cable and the connector head, thereby securing the coaxial cable from withdrawal from the recess;

wherein the pressure member includes an elastic perimeter seal comprising at least one annular lip projecting from an interior surface of the perimeter seal and having an inside diameter that, in an unloaded state, is smaller than the largest outer diameter of the outer conductor of the coaxial cable, wherein the annular lip deforms when the pressure member is slid onto the coaxial cable, and wherein, after clamping, the annular lip is situated approximately in the same radial plane as in the unloaded state; and wherein the perimeter seal is arranged in a sleeve-like manner around the coaxial cable and projects axially beyond the pressure member on a cable-side end, and the perimeter seal comprises at least one further lip arranged at an axial distance from the annular lip and at the cable-side end of the perimeter seal, the at least one further lip further being arranged so as to rest on a sheath of the coaxial cable.

2. The apparatus of claim 1, wherein the perimeter seal is fixed in the pressure member in a form-fitting fashion.

3. The apparatus of claim 1, wherein the perimeter seal is fixed in at least one annular groove in the pressure member.

4. The apparatus of claim 1, wherein the annular lip rests on the outer cable conductor.

5. The apparatus of claim 1, wherein a cap nut for axially compressing the further lip is screwed onto the cable-side end of the pressure member.

6. The apparatus of claim 1, wherein the coaxial cable includes a ring-wave outer conductor and, after clamping, the annular lip intersects the ring-wave outer conductor at the transition from one wave crest to a next wave trough.

7. The apparatus of claim 1, wherein the pressure member is a banjo bolt which can be screwed into the recess of the connector head.

8. The apparatus of claim 1, wherein the connector head can be slid in a pre-mounted state onto the cable in one piece and is provided with a configuration so that it can make contact and be clamped with the same.

* * * * *